US005948455A

United States Patent [19]

Schaeffer et al.

[11] Patent Number: 5,948,455

[45] Date of Patent: Sep. 7, 1999

[54] CARTRIDGE HAVING SHEARED THINNED AREAS FOR PROMOTING OPENING FOR BEVERAGE EXTRACTION

[75] Inventors: Jacques Schaeffer, Chardonne; Alfred Yoakim, La Tour-de-Peilz, both of Switzerland

[73] Assignee: Nestec S.A., Vevey, Switzerland

[21] Appl. No.: 08/820,875

[22] Filed: Mar. 20, 1997

[30] Foreign Application Priority Data

May 10, 1996 [EP] European Pat. Off. ..... 96201250

[51] Int. Cl.[6] ..... B65B 29/02

[52] U.S. Cl. ..... 426/77; 426/84; 426/112; 426/115; 99/295

[58] Field of Search ..... 426/77, 84, 112, 426/115, 433; 99/295

[56] References Cited

U.S. PATENT DOCUMENTS

| | | | |
|---|---|---|---|
| 2,451,195 | 10/1948 | Brown . | |
| 2,778,739 | 1/1957 | Rodth . | |
| 2,936,695 | 5/1960 | Donot . | |
| 3,292,527 | 12/1966 | Strasse . | |
| 3,589,272 | 6/1971 | Bouladon et al. . | |
| 3,607,297 | 9/1971 | Fasano . | |
| 4,136,202 | 1/1979 | Favre . | |
| 4,167,899 | 9/1979 | McCormick | 426/77 |
| 4,292,332 | 9/1981 | McHam . | |
| 4,846,052 | 7/1989 | Favre et al. . | |
| 5,242,702 | 9/1993 | Fond | 426/77 |
| 5,472,719 | 12/1995 | Favre | 426/77 |
| 5,656,311 | 8/1997 | Fond . | |

FOREIGN PATENT DOCUMENTS

| | | | |
|---|---|---|---|
| 0389141 | 9/1990 | European Pat. Off. . | |
| 0521510 | 7/1993 | European Pat. Off. . | |
| 1537031 | 7/1968 | France . | |
| 2033190 | 12/1970 | France . | |
| 2211924 | 7/1974 | France . | |
| 2617389 | 1/1989 | France . | |
| 314618 | 2/1934 | Italy . | |
| 458099 | 2/1968 | Switzerland . | |
| 605293 | 9/1978 | Switzerland . | |
| 2023086 | 12/1979 | United Kingdom . | |
| WO9401344 | 1/1994 | WIPO | 426/77 |

OTHER PUBLICATIONS

Baker, Ed., The Wiley Encyclopedia of Packing Technology, John Wiley and Sons, NY, 1986, pp. 48–53 and 270–275.

*Primary Examiner*—Steven Weinstein
*Attorney, Agent, or Firm*—Vogt & O'Donnell, LLP

[57] ABSTRACT

A cartridge which contains a substance for preparation of a beverage and for use for preparation of the beverage. The cartridge has a base, a wall, a rim and a cover. The wall extends from the base to form a cup shape which is substantially a frustum shape, the rim extends from the wall and has a diameter greater than the base and the cover is welded to the rim to contain the substance in the cartridge. The base further has sheared areas thinned, with respect to a base remainder, which extend to define arrangements which are spiral, substantially sinusoidal portions, radial segments and concentric arcs of a circle and which, along a line of each sheared area to define thickness, have a thickness which varies along the line, the sheared areas providing, upon extraction of the substance in the cartridge under pressure, openings through the base for filtering and obtaining the beverage.

16 Claims, 2 Drawing Sheets

CARTRIDGE HAVING SHEARED THINNED AREAS FOR PROMOTING OPENING FOR BEVERAGE EXTRACTION

BACKGROUND OF THE INVENTION

1. Field of the Invention

The invention relates to a closed cartridge, provided in order to be extracted under pressure, containing a substance for the preparation of a beverage, comprising a cup with a base and a lateral wall having substantially the shape of a frustum of a cone and a circular rim with a diameter greater than the base, and a cover welded to the perimeter of the rim of the cup, the base of the cup including thinner areas intended to promote the opening of the cartridge at the time of extraction.

2. Prior Art

European Patent Application Publication No. 0521 510 already relates to packaging in the form of a closed, rigid cartridge containing a substance for making a beverage and including thinner areas. The drawback with this cartridge is that, at the time of its extraction, it requires the presence, under the lower face which has the thinner areas, of projecting elements. The fact that these projecting elements are provided constitutes a dual drawback, on the one hand, this system increases the price, and, on the other hand, the points become blunt and it is necessary to monitor their efficiency over time.

SUMMARY OF THE INVENTION

The object of the present invention is to provide a cartridge which has areas which become thinner so that it can be extracted without a projecting element.

The invention relates to a closed cartridge which provides for extraction, under pressure, of a substance contained within the cartridge for the preparation of a beverage, wherein the cartridge comprises a base and a wall and a rim, wherein the wall extends laterally from the base to provide a cup having substantially the shape of a frustum and wherein the rim extends from the wall and is circular and has a diameter greater than the base, and wherein the cartridge further comprises a cover welded to the perimeter of the rim of the cup, and wherein the base includes thinner areas for promoting the opening of the cartridge at the time of extraction, and the invention is characterized in that the cup is made from aluminum or an aluminum-based alloy and the thinner areas are produced by shearing and have the form of concentric arcs of a circle of the same radius, concentric arcs of a circle of different radii, of a spiral, of substantially sinusoidal portions or of radial segments.

DETAILED DESCRIPTION OF THE INVENTION

In the present description, aluminum alloy means mixture comprising at least 90% of aluminum and a second metallic component chosen from the group consisting of iron, silicon, manganese, magnesium, chrome, copper, zinc and the like.

The cartridge is filled with a substance for the preparation of a beverage. This substance is preferably ground, roast coffee, but may also be tea, instant coffee, a mixture of ground coffee and instant coffee, a chocolate-based product or any other dehydrated edible substance.

The advantage of having such a cartridge available is that it is placed in its cartridge holder, provided with a support which has openings allowing the beverage, e.g., coffee, to flow, and at the time of extraction, the simple fact of having a rise in pressure in the cartridge permits opening in the thinner areas. Obviously, these thinner areas must have a specific geometry, and, in the case of the material in question, must have an adequate residual thickness. During tests it was observed that satisfactory extraction was achieved with thinner areas which had a thickness which was substantially half that of the starting thickness. There is no point at all in having a filter inside the cartridge since opening along the thinning lines is such that it carries out this operation. Coffee grounds are retained by controlled opening of the cartridge.

It is important for the thinning areas to be created by shearing and not by punching.

The cover must be flexible and slightly extendible, to facilitate perforation. The cover has a thickness which is less than that of the cup, for example of between 20 and 60 microns.

The cup must have a degree of rigidity, for example for when it is handled by the consumer. It therefore has a thickness of between 50 and 150 microns and more preferably of between 70 and 100 microns.

Obviously a cartridge holder has to be provided which has a base for supporting the cartridge face provided with the thinner areas, this support being necessary to control opening so that the filter function is indeed fulfilled at the time the cartridge is opened.

The cartridge preferably contains ground, roast coffee. The coffee is arranged in the cartridge either as it is, or is compressed or compacted. Compressed is understood to mean compression at a pressure of the order of a few hundreds of kilograms. Compacted is understood to mean compression at a pressure of the order of a few tons. The coffee in the cartridge is preferably compressed.

To facilitate opening of the cartridge, thinner areas may be provided which have thicknesses which can vary along said areas, for example, a residual thickness of 40 microns which varies up to 60 microns may be provided. Opening will take place firstly over the 40-micron area and will continue along the extent of the distance of the sheared area toward the greater thickness. This also allows automatic regulation of the extraction pressure.

The second possibility for facilitating opening is to provide, at the start of the thinner area, a starting initiator, for example via a notch with a residual thickness of 40 microns whereas the remainder of the area is 50 microns thick.

In a specific embodiment, the closed cartridge according to the invention consists of a cup made from an aluminum, alloy having a thickness of the order of 85 microns and with thinner areas in the form of concentric arcs of the same radius with a thickness of between 40 and 50 microns. When using a coffee machine which goes up to 12 bar, a 120-ml cup may be extracted in 50 seconds, with no grounds passing through.

BRIEF DESCRIPTION OF THE DRAWING FIGURES

The remainder of the description is made with reference to the accompanying drawings.

DETAILED DESCRIPTION OF THE DRAWING FIGURES

Figure 1:
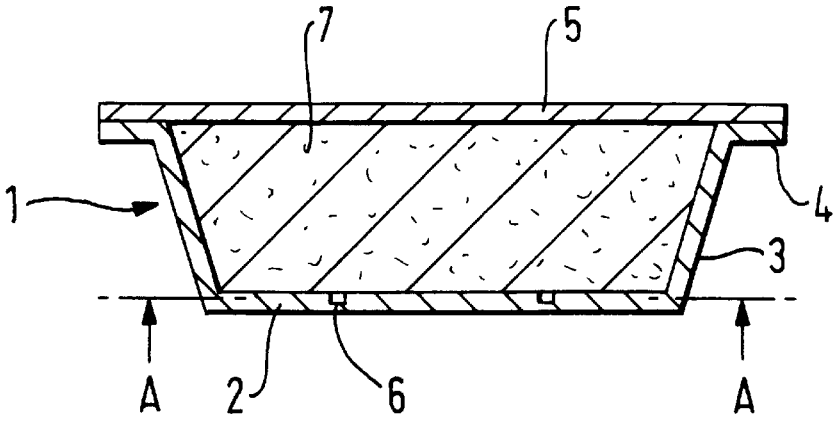
FIG. 1 is a diagrammatic section through the middle of a cartridge according to the inventions.
Figure 2:
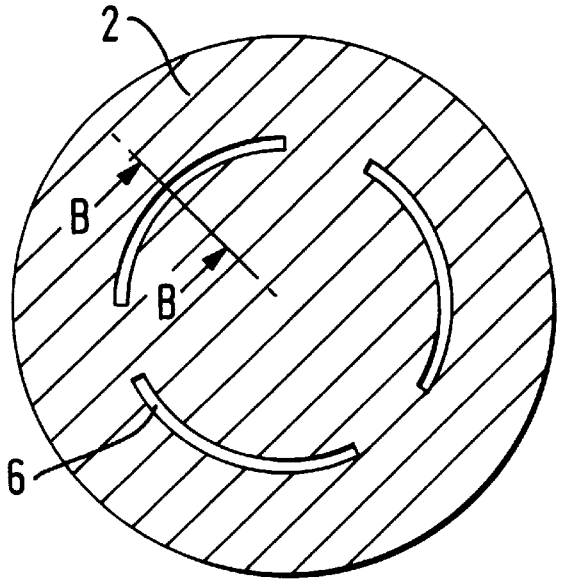
FIG. 2 is a section along A—A in FIG. 1.

With reference to FIGS. 1 and 2, the cartridge is composed of a cup (1) consisting of a base (2), a lateral wall (3)

and a rim (4), as well as a cover (5). The cup and the cover are made from an aluminum alloy, the cup having a thickness of 85 microns and the cover a thickness of 60 microns. The cover is heat-sealed onto the rim (4) of the cup. The base (2) of the cup, as shown in FIG. 2, has three areas (6) arranged in the form of arcs of a circle which are thinner than the thickness of the remainder of the base. As already mentioned above, these areas are obtained by shearing with the aid of drawing presses. The cartridge contains ground, roast coffee (7). At the time of extraction, opening of the areas (6) enables the coffee extracts to pass through, but also guarantees satisfactory retention of the coffee grounds. The residual thickness in the areas (6) is 40 microns.

Figure 3:
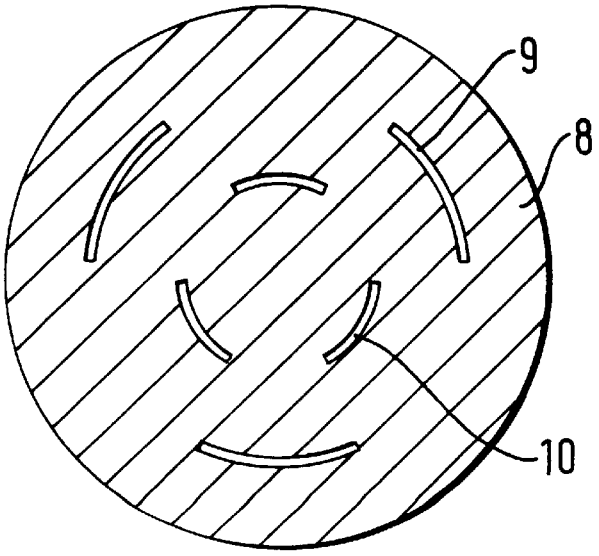
FIGS. 3, 4, 5 and 6 are sections similar to that in FIG. 2, but showing different geometries for the thinner areas.

As shown in FIG. 3, it is also possible to provide thinner areas over arcs of a circle arranged at different distances from the center of the base (8) of the cup. Areas (9) and areas (10) are thus produced. The advantage of this arrangement is that, at the time of extraction, it is firstly the areas closest to the center, i.e. (10), which will open.

Figure 4:
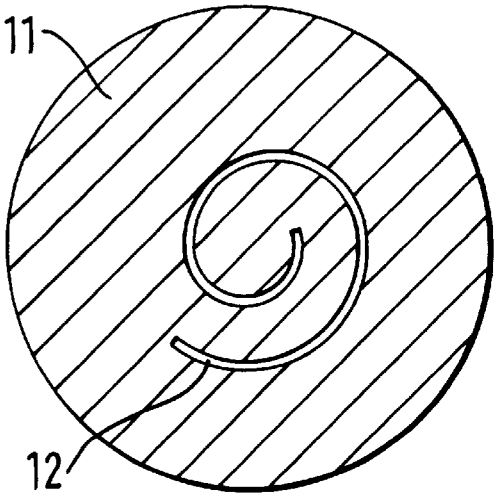

In the case of FIG. 4, there is a base (11) which has an area (12) in the form of a spiral.

Figure 5:
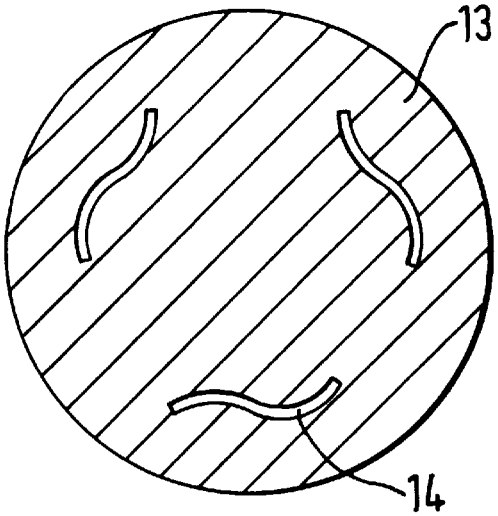

FIG. 5 shows a cup base (13) which has thinner areas (14) arranged in a substantially sinusoidal form.

Figure 6:
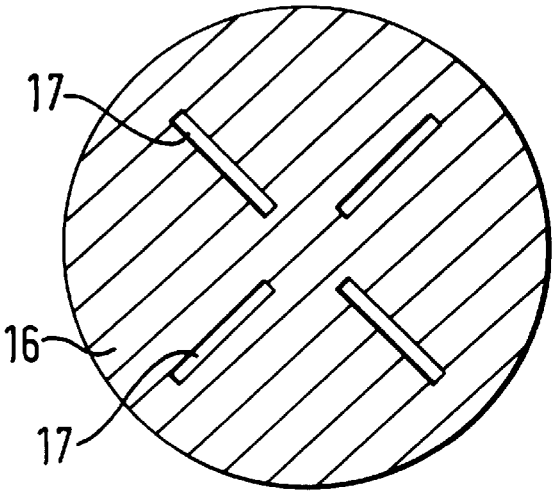

FIG. 6 shows a cup base (16) having thinner areas (17) arranged in the form of radial segments.

Figure 7:
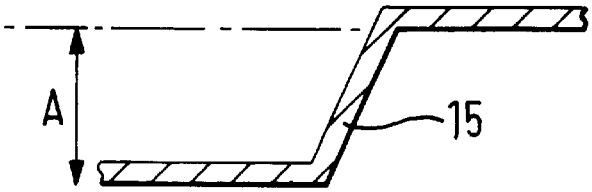
FIG. 7 is a section along B—B at a thinner point.

Finally, FIG. 7 shows a sectional enlargement of the thinner location obtained by shearing. As already mentioned above, the part (15) has a residual thickness of 40 microns. The distance A is between 0.2 and 1 mm.

According to the invention, this is a cartridge of relatively simple design which makes it possible to carry out an extraction operation with a cartridge holder of specific design and which makes it possible to prepare an espresso-type coffee, i.e. with a rise in pressure of the order of 10 bar.

We claim:

1. In a cartridge containing a substance for preparation of a beverage wherein the cartridge comprises a base, a well and a rim, wherein the wall extends laterally from the base to form a cup having a shape which is substantially a frustrum shape and wherein the rim extends from the wall and has a diameter greater than the base, wherein the cartridge comprises a cover welded to the rim to contain the substance within the cartridge and wherein the base has areas thinned with respect to a remainder of the base so that upon extraction of the substance in the cartridge under pressure, the thinned areas provide openings through the base for filtering and obtaining the beverage, the improvements comprising the cup base and wall being comprised of at least 90% aluminum and comprising the thinned areas being sheared areas which define an arrangement selected from the group consisting of a spiral, of substantially sinusoidal portions, of radial segments and of concentric arcs of a circle and wherein each sheared area extends for a distance and comprises a thickness which varies along its extent to provide the opening.

2. In a cartridge containing a substance for preparation of a beverage wherein the cartridge comprises a base, a wall and a rim, wherein the wall extends laterally from the base to form a cup having a shape which is substantially a frustrum shape and wherein the rim extends from the wall and has a diameter greater than the base, wherein the cartridge comprises a cover welded to the rim to contain the substance within the cartridge and wherein the base has areas thinned with respect to a remainder of the base so that upon extraction of the substance in the cartridge under pressure, the thinned areas provide openings through the base for filtering and obtaining the beverage, the improvements comprising the cup base and wall being comprised of at least 90% aluminum and comprising the thinned areas being formed by shearing the base to provide sheared thinned areas which define an arrangement selected from the group consisting of a spiral, of substantially sinusoidal portions, of radial segments and of concentric arcs of a circle and wherein each sheared area extends for a distance and comprises a thickness which varies along its extent to provide the opening.

3. A cartridge according to claim 1 or 2 wherein the thickness of each sheared area varies in a range between 40 microns and 60 microns along its extent.

4. A cartridge according to claim 3 wherein the sheared areas comprise a portion which defines a notch.

5. A cartridge according to claim 3 wherein the non-thinned base remainder has a thickness between 50 microns and 150 microns.

6. A cartridge according to claim 3 wherein the non-thinned base remainder has a thickness between 70 microns and 100 microns.

7. A cartridge according to claim 1 or 2 wherein the sheared areas comprise a portion which defines a notch.

8. A cartridge according to claim 7 wherein each sheared area notch has a thickness of 40 microns and wherein a remainder of each sheared area comprises a thickness of 50 microns.

9. A cartridge according to claim 1 or 2 wherein the non-thinned base remainder has a thickness between 50 microns and 150 microns.

10. A cartridge according to claim 9 wherein the non-thinned base remainder has a thickness between 70 microns and 100 microns.

11. A cartridge according to claim 1 or 2 wherein the cup base non-thinned base remainder has a thickness on an order of 85 microns and wherein the thickness of each sheared area varies between 40 microns and 50 microns along its extent and the sheared areas are arranged to define concentric arcs having a same radius.

12. A cartridge according to claim 1 or 2 wherein the cup base and wall are further comprised of a substance selected from the group consisting of iron, manganese, magnesium chrome, copper, zinc and silicon.

13. A cartridge according to claim 1 or 2 wherein the substance is ground roast coffee.

14. A cartridge according to claim 13 wherein the ground roast coffee is in a form which is selected from the group consisting of a compressed form and a compacted form.

15. A cartridge according to claim 1 or 2 wherein the cover has a thickness less than a thickness of the cup base remainder and wall.

16. A cartridge according to claim 1 or 2 wherein the cover has a thickness of from 20 microns to 60 microns.

* * * * *

UNITED STATES PATENT AND TRADEMARK OFFICE

CERTIFICATE OF CORRECTION

PATENT NO. : 5, 948, 455

DATED : September 7, 1999

INVENTOR(S) : Jacques SCHAEFFER, *et al.*

It is certified that error appears in the above-identified patent and that said Letters Patent is hereby corrected as shown below:

Column 1, line 54 (first text line after the 'DETAILED DESCRIPTION" heading) after "means", insert -- a -.

Column 2, line 58, change "inventions" to -- invention --.

Column 3, line 38 (line 2 of claim 1), delete "well" and insert therefor -- wall --.

Signed and Sealed this

Eighteenth Day of April, 2000

*Attest:*

Q. TODD DICKINSON

*Attesting Officer*

*Director of Patents and Trademarks*